US007578038B2

(12) United States Patent
McMillan et al.

(10) Patent No.: US 7,578,038 B2
(45) Date of Patent: Aug. 25, 2009

(54) APPARATUS AND METHODS FOR REMOTE INSTALLATION OF DEVICES FOR REDUCING DRAG AND VORTEX INDUCED VIBRATION

(75) Inventors: David Wayne McMillan, Houston, TX (US); Richard Bruce McDaniel, Houston, TX (US)

(73) Assignee: Shell Oil Company, Houston, TX (US)

( * ) Notice: Subject to any disclaimer, the term of this patent is extended or adjusted under 35 U.S.C. 154(b) by 496 days.

(21) Appl. No.: 10/784,536

(22) Filed: Feb. 23, 2004

(65) Prior Publication Data

US 2005/0175415 A1 Aug. 11, 2005

Related U.S. Application Data

(63) Continuation of application No. 10/032,710, filed on Oct. 19, 2001, now Pat. No. 6,695,539.

(51) Int. Cl.
*B23P 11/00* (2006.01)
*E02D 5/60* (2006.01)

(52) U.S. Cl. ..... 29/428; 29/464; 29/402.09; 405/211; 405/216

(58) Field of Classification Search ..... 29/428, 29/464, 402.09, 728; 405/190, 191, 188, 405/184.2, 184.1, 184.4, 158, 211, 216; 166/335, 338, 356
See application file for complete search history.

(56) References Cited

U.S. PATENT DOCUMENTS 1,374,512 A * 4/1921 Maynard ..... 405/190
1,385,682 A * 7/1921 Haynie ..... 405/190
2,934,033 A * 4/1960 Knights et al. ..... 114/51
3,163,221 A 12/1964 Shatto, Jr. ..... 166/66.5
3,165,899 A * 1/1965 Shatto, Jr. ..... 405/191
3,222,875 A * 12/1965 Justus ..... 405/190
3,321,924 A * 5/1967 Liddell ..... 405/216
3,367,299 A * 2/1968 Sayre, Jr. ..... 114/51
3,381,485 A 5/1968 Crooks et al. ..... 61/69
3,400,541 A * 9/1968 Schlissler et al. ..... 405/190
3,434,295 A 3/1969 Manning ..... 61/72.3
3,508,410 A * 4/1970 Lynch ..... 405/190
3,635,183 A * 1/1972 Keatinge ..... 114/330
3,720,433 A * 3/1973 Rosfelder ..... 294/64.1
3,759,563 A * 9/1973 Kitamura ..... 294/88
3,851,491 A * 12/1974 Mason ..... 405/188
3,860,122 A * 1/1975 Cernosek ..... 414/732
3,899,991 A 8/1975 Chatten et al. ..... 114/235
4,010,619 A 3/1977 Hightower et al. ..... 61/69 R (Continued)

FOREIGN PATENT DOCUMENTS

EP 930136 A2 7/1999

OTHER PUBLICATIONS

D. W. Allen, Vortex Induced Vibration Suppression of Cylindrical Structures, Apr. 1994, pp. 1-88.

*Primary Examiner*—Essama Omgba
(74) *Attorney, Agent, or Firm*—William E. Hickman

(57) ABSTRACT

Apparatus and methods for remotely installing vortex-induced vibration (VIV) reduction and drag reduction devices on elongated structures in flowing fluid environments. The apparatus is a tool for transporting and installing the devices. The devices installed can include clamshell-shaped strakes, shrouds, fairings, sleeves and flotation modules.

7 Claims, 17 Drawing Sheets

U.S. PATENT DOCUMENTS 4,043,134 A * 8/1977 Mason ..... 405/188
4,098,088 A * 7/1978 Mason ..... 405/188
4,116,015 A 9/1978 Duncan ..... 405/169
4,398,487 A 8/1983 Ortloff et al. ..... 114/243
4,405,263 A * 9/1983 Hall ..... 405/224
4,443,130 A * 4/1984 Hall ..... 405/190
4,460,208 A * 7/1984 Hoffman ..... 294/65
4,501,056 A * 2/1985 Castel et al. ..... 29/252
4,620,819 A * 11/1986 Marsland et al. ..... 435/185
4,636,137 A * 1/1987 Lemelson ..... 414/730
4,648,782 A * 3/1987 Kraft ..... 414/735
4,669,915 A * 6/1987 Shatto, Jr. ..... 405/191
4,674,915 A * 6/1987 Shatto, Jr. ..... 405/191
4,701,074 A * 10/1987 Hall ..... 405/169
4,705,331 A * 11/1987 Britton ..... 439/387
4,721,055 A * 1/1988 Pado ..... 405/191
4,732,215 A * 3/1988 Hopper ..... 166/366
4,784,525 A * 11/1988 Francois ..... 405/191
4,832,530 A * 5/1989 Andersen et al. ..... 405/170
4,906,136 A * 3/1990 Norbom et al. ..... 405/169
4,943,187 A * 7/1990 Hopper ..... 405/190
4,974,996 A * 12/1990 Vielmo et al. ..... 405/188
5,039,254 A * 8/1991 Piercy ..... 405/191
5,042,959 A * 8/1991 Tadatsu ..... 405/191
5,074,712 A * 12/1991 Baugh ..... 405/158
5,279,368 A * 1/1994 Arnott ..... 166/356
5,340,237 A * 8/1994 Reis et al. ..... 405/169
5,410,979 A 5/1995 Allen et al. ..... 114/243
5,421,413 A 6/1995 Allen et al. ..... 166/335
5,501,549 A * 3/1996 Breda et al. ..... 405/169
5,549,417 A 8/1996 Ju et al. ..... 405/211
5,593,249 A 1/1997 Cox et al. ..... 405/191
5,738,034 A 4/1998 Wolff et al. ..... 114/242
5,775,844 A * 7/1998 Nelson ..... 405/188
5,875,728 A 3/1999 Ayers et al. ..... 114/264
5,975,803 A * 11/1999 Mackinnon ..... 405/169
6,010,278 A 1/2000 Denison et al. ..... 405/216
6,019,549 A 2/2000 Blair et al. ..... 405/216
6,024,514 A * 2/2000 Ostergaard ..... 405/170
6,068,427 A * 5/2000 Åstergaard ..... 405/191
6,092,483 A 7/2000 Allen et al. ..... 114/264
6,179,524 B1 1/2001 Allen et al. ..... 405/211
6,196,768 B1 3/2001 Allen et al. ..... 405/224
6,223,672 B1 5/2001 Allen et al. ..... 114/243
6,227,137 B1 5/2001 Allen et al. ..... 114/264
6,263,824 B1 7/2001 Balint et al. ..... 114/264
6,309,141 B1 10/2001 Cox et al. ..... 405/224
6,347,911 B1 * 2/2002 Blair et al. ..... 405/216
6,401,646 B1 6/2002 Masters et al. ..... 114/243
6,551,029 B2 4/2003 Shu et al. ..... 405/211
6,561,734 B1 5/2003 Allen et al. ..... 405/216
6,565,287 B2 5/2003 McMillan et al. ..... 405/211.1
6,571,878 B2 6/2003 McDaniel et al. ..... 166/367
6,644,894 B2 11/2003 Shu et al. ..... 405/211
6,685,394 B1 2/2004 Allen et al. ..... 405/211
6,695,539 B2 * 2/2004 McMillan et al. ..... 405/191
6,695,540 B1 2/2004 Taquino ..... 405/216
6,702,026 B2 3/2004 Allen et al. ..... 166/367
6,789,578 B2 * 9/2004 Latham et al. ..... 138/89
6,886,487 B2 5/2005 Fischer, III ..... 114/230.1
6,928,709 B2 8/2005 McMillan et al. ..... 29/281.1
6,971,413 B2 * 12/2005 Taylor et al. ..... 138/99
6,994,492 B2 2/2006 McMillan et al. ..... 405/216
7,017,666 B1 3/2006 Allen et al. ..... 166/367
2002/0168232 A1 * 11/2002 Xu et al. ..... 405/224
2004/0175240 A1 9/2004 McMillan ..... 405/211
2004/0258482 A1 * 12/2004 Mackinnon ..... 405/188
2004/0265066 A1 * 12/2004 Mackinnon ..... 405/170

* cited by examiner

FIG. 12
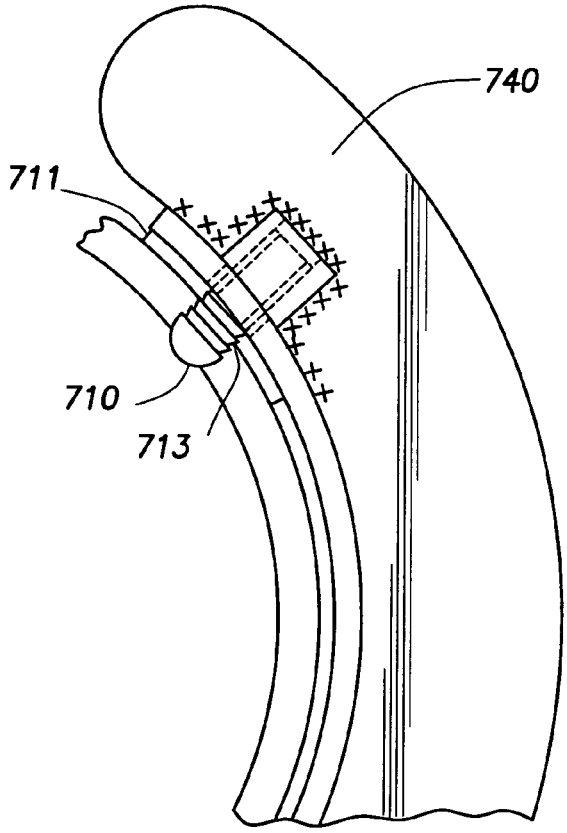
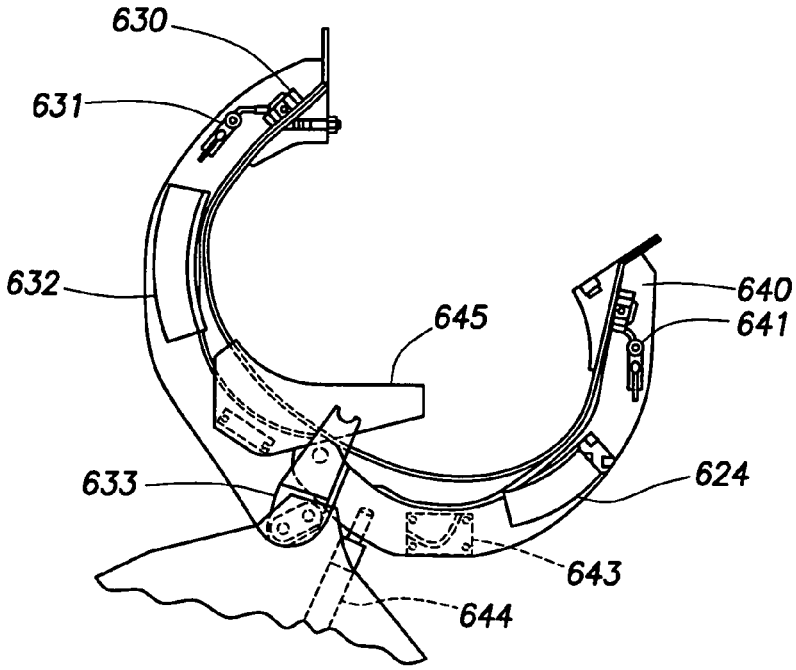
FIG. 13

FIG.25A
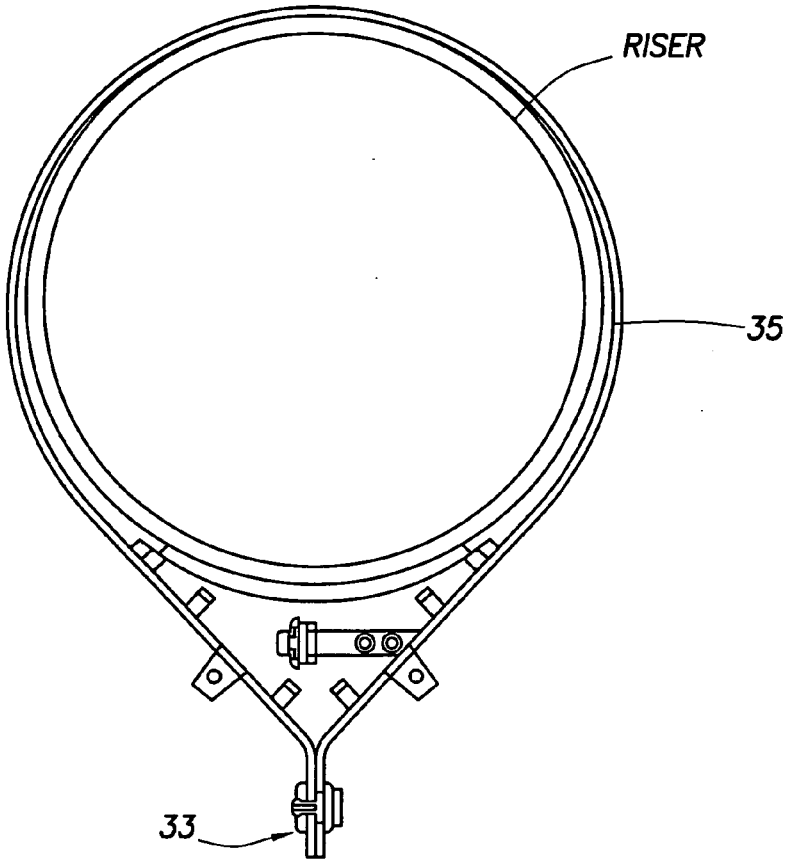
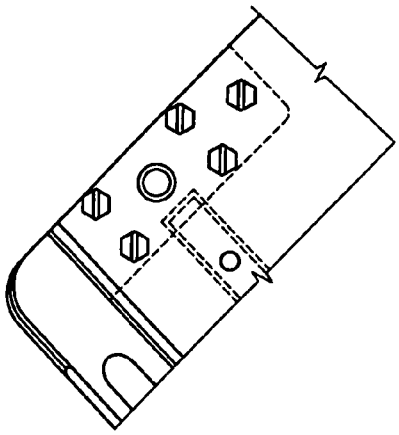
FIG.25B
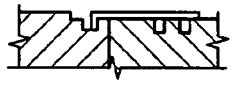
FIG.25C

APPARATUS AND METHODS FOR REMOTE INSTALLATION OF DEVICES FOR REDUCING DRAG AND VORTEX INDUCED VIBRATION

RELATED APPLICATION DATA

This application is a Divisional application of U.S. patent application Ser. No. 10/032,710 filed Oct. 19, 2001, issued Feb. 24, 2004 as U.S. Pat. No. 6,695,539, the disclosure of which is incorporated by reference.

BACKGROUND OF THE INVENTION

1. Field of the Invention

The present invention relates to apparatus and methods for remotely installing vortex-induced vibration (VIV) and drag reduction devices on structures in flowing fluid environments. In another aspect, the present invention relates to apparatus and methods for installing VIV and drag reduction devices on underwater structures using equipment that can be remotely operated from above the surface of the water. In even another aspect, the present invention relates to apparatus and methods for remotely installing VIV and drag reduction devices on structures in an atmospheric environment using equipment that can be operated from the surface of the ground.

2. Description of the Related Art

Whenever a bluff body, such as a cylinder, experiences a current in a flowing fluid environment, it is possible for the body to experience vortex-induced vibrations (VIV). These vibrations are caused by oscillating dynamic forces on the surface which can cause substantial vibrations of the structure, especially if the forcing frequency is at or near a structural natural frequency. The vibrations are largest in the transverse (to flow) direction; however, in-line vibrations can also cause stresses which are sometimes larger than those in the transverse direction.

Drilling for and/or producing hydrocarbons or the like from subterranean deposits which exist under a body of water exposes underwater drilling and production equipment to water currents and the possibility of VIV. Equipment exposed to VIV includes structures ranging from the smaller tubes of a riser system, anchoring tendons, or lateral pipelines to the larger underwater cylinders of the hull of a minispar or spar floating production system (hereinafter "spar").

Risers are discussed here as a non-exclusive example of an aquatic element subject to VIV. A riser system is used for establishing fluid communication between the surface and the bottom of a water body. The principal purpose of the riser is to provide a fluid flow path between a drilling vessel and a well bore and to guide a drill string to the well bore.

A typical riser system normally consists of one or more fluid-conducting conduits which extend from the surface to a structure (e.g., wellhead) on the bottom of a water body. For example, in the drilling of a submerged well, a drilling riser usually consists of a main conduit through which the drill string is lowered and through which the drilling mud is circulated from the lower end of the drill string back to the surface. In addition to the main conduit, it is conventional to provide auxiliary conduits, e.g., choke and kill lines, etc., which extend parallel to and are carried by the main conduit.

This drilling for and/or producing of hydrocarbons from aquatic, and especially offshore, fields has created many unique engineering challenges. For example, in order to limit the angular deflections of the upper and lower ends of the riser pipe or anchor tendons and to provide required resistance to lateral forces, it is common practice to use apparatus for adding axial tension to the riser pipe string. Further complexities are added when the drilling structure is a floating vessel, as the tensioning apparatus must accommodate considerable heave due to wave action. Still further, the lateral forces due to current drag require some means for resisting them whether the drilling structure is a floating vessel or a platform fixed to the subsurface level.

The magnitude of the stresses on the riser pipe, tendons or spars is generally a function of and increases with the velocity of the water current passing these structures and the length of the structure.

It is noted that even moderate velocity currents in flowing fluid environments acting on linear structures can cause stresses. Such moderate or higher currents are readily encountered when drilling for offshore oil and gas at greater depths in the ocean or in an ocean inlet or near a river mouth.

Drilling in ever deeper water depths requires longer riser pipe strings which because of their increased length and subsequent greater surface area are subject to greater drag forces which must be resisted by more tension. This is believed to occur as the resistance to lateral forces due to the bending stresses in the riser decreases as the depth of the body of water increases.

Accordingly, the adverse effects of drag forces against a riser or other structure caused by strong and shifting currents in these deeper waters increase and set up stresses in the structure which can lead to severe fatigue and/or failure of the structure if left unchecked.

There are generally two kinds of current-induced stresses in flowing fluid environments. The first kind of stress is caused by vortex-induced alternating forces that vibrate the structure ("vortex-induced vibrations") in a direction perpendicular to the direction of the current. When fluid flows past the structure, vortices are alternately shed from each side of the structure. This produces a fluctuating force on the structure transverse to the current. If the frequency of this harmonic load is near the resonant frequency of the structure, large vibrations transverse to the current can occur. These vibrations can, depending on the stiffness and the strength of the structure and any welds, lead to unacceptably short fatigue lives. In fact, stresses caused by high current conditions in marine environments have been known to cause structures such as risers to break apart and fall to the ocean floor.

The second type of stress is caused by drag forces which push the structure in the direction of the current due to the structure's resistance to fluid flow. The drag forces are amplified by vortex induced vibrations of the structure. For instance, a riser pipe that is vibrating due to vortex shedding will disrupt the flow of water around it more than a stationary riser. This results in more energy transfer from the current to the riser, and hence more drag.

Many types of devices have been developed to reduce vibrations of subsea structures. Some of these devices used to reduce vibrations caused by vortex shedding from subsea structures operate by stabilization of the wake. These methods include use of streamlined fairings, wake splitters and flags.

Streamlined or teardrop shaped, fairings that swivel around a structure have been developed that almost eliminate the shedding of vortices. The major drawbacks to teardrop shaped fairings is the cost of the fairing and the time required to install such fairings. Additionally, the critically required rotation of the fairing around the structure is challenged by long-term operation in the undersea environment. Over time in the harsh marine environment, fairing rotation may either be hindered or stopped altogether. Anon-rotating fairing subjected to a cross-current may result in vortex shedding that induces greater vibration than the bare structure would incur.

Other devices used to reduce vibrations caused by vortex shedding from sub-sea structures operate by modifying the boundary layer of the flow around the structure to prevent the correlation of vortex shedding along the length of the structure. Examples of such devices include sleeve-like devices such as helical strakes, shrouds, fairings and substantially cylindrical sleeves.

Some VIV and drag reduction devices can be installed on risers and similar structures before those structures are deployed underwater. Alternatively, VIV and drag reduction devices can be installed by divers on structures after those structures are deployed underwater.

Use of human divers to install VIV and drag reduction equipment at shallower depths can be cost effective. However, strong currents can also occur at great depths causing VIV and drag of risers and other underwater structures at those greater depths. However, using divers to install VIV and drag reduction equipment at greater depths subjects divers to greater risks and the divers cannot work as long as they can at shallower depths. The fees charged, therefore, by diving contractors are much greater for work at greater depths than for shallower depths. Also, the time required by divers to complete work at greater depths is greater than at shallower depths, both because of the shorter work periods for divers working at great depths and the greater travel time for divers working at greater depths. This greater travel time is caused not only by greater distances between an underwater work site and the water surface, but also by the requirement that divers returning from greater depths ascend slowly to the surface. Slow ascent allows gases, such as nitrogen, dissolved in the diver's blood caused by breathing air at greater depths, to slowly return to a gaseous state without forming bubbles in the diver's blood circulation system. Bubbles formed in the blood of a diver who ascends too rapidly cause the diver to experience the debilitating symptoms of the bends.

Elongated structures in wind in the atmosphere can also encounter VIV and drag, comparable to that encountered in aquatic environments. Likewise, elongated structures with excessive VIV and drag forces that extend far above the ground can be difficult, expensive and dangerous to reach by human workers to install VIV and drag reduction devices.

However, in spite of the above advancements, there still exists a need in the art for apparatus and methods for installing VIV and drag reduction devices on structures in flowing fluid environments.

There is another need in the art for apparatus and methods for installing VIV and drag reduction devices on structures in flowing fluid environments, which do not suffer from the disadvantages of the prior art apparatus and methods.

There is even another need in the art for apparatus and methods for installing VIV and drag reduction equipment on underwater structures without using human divers.

There is still another need in the art for apparatus and methods for installing VIV and drag reduction devices on underwater structures using equipment that can be remotely operated from the surface of the water.

There is yet another need in the art for apparatus and methods for installing VIV and drag reduction devices on above-ground devices using equipment that can be operated from the surface of the ground.

These and other needs in the art will become apparent to those of skill in the art upon review of this specification, including its drawings and claims.

SUMMARY OF THE INVENTION

It is an object of the present invention to provide for apparatus and methods for installing VIV and drag reduction devices on structures in flowing fluid environments.

It is another object of the present invention to provide for apparatus and methods for installing VIV and drag reduction devices on structures in flowing fluid environments, which do not suffer from the disadvantages of the prior art apparatus and methods.

It is even another object of the present invention for apparatus and methods for installing VIV and drag reduction devices on underwater structures without using human divers.

It is still an object of the present invention to provide for apparatus and methods for installing VIV and drag reduction devices on underwater structures using equipment that can be remotely operated from the surface of the water.

It is yet another object for the present invention to provide for apparatus and methods for installing VIV and drag reduction devices on above-ground structures using equipment that can be operated from the surface of the ground.

These and other objects of the present invention will become apparent to those of skill in the art upon review of this specification, including its drawings and claims.

According to one embodiment of the present invention, there is provided a tool for remotely installing a device around an element. The tool generally includes a frame and a hydraulic system supported by the frame. The tool further includes at least one set of two clamps supported by the frame, the set suitable for holding and releasing the clamshell device selected from the group consisting of vortex-induced vibration reduction devices and drag reduction devices. The set of clamps is connected to the hydraulic system.

According to another embodiment of the present invention, there is provided a method of remotely installing a device around an element having a diameter. The method generally includes positioning a tool adjacent to the element, wherein the tool carries the clamshell device selected from the group consisting of vortex-induced vibration reduction devices and drag reduction devices. The method next includes moving the tool to position the clamshell device around the element. The method further includes operating the tool to close the clamshell device around the element, wherein the device covers from about 50% to about 100% of the diameter of the element. The method finally includes securing the device in position around the diameter of the element.

These and other embodiments of the present invention will become apparent to those of skill in the art upon review of this specification, including its drawings and claims.

BRIEF DESCRIPTION OF THE DRAWINGS

FIG. 12 is an alternative embodiment showing nipple 710 positioned on arm 740, and received into passage 713 in the strake.

FIG. 13 is a top view of alternative clamp 600 with a fairing installed.

FIG. 15 shows a collar 22 being inserted thereto; FIG. 16 shows a collar half rotated into fixed insert; FIG. 17 shows an opposite half of the collar rotated into moving insert; FIG. 18 shows the DSDT being moved onto the pipe 23; FIG. 19 shows a further advance of the DSDT being moved onto the pipe; FIG. 20 shows an even further advance of the DSDT being moved onto the pipe; FIG. 21 shows the cylinder closing the fairing clamp as the collar grip drives the collar closed; FIG. 22 shows a further advance of the cylinder closing the fairing clamp as the collar grip drives the collar closed; FIG. 23 shows an even further advance of the cylinder closing the fairing clamp as the collar grip drives the collar closed; FIG. 24 shows the DSDT moving away from the riser pipe with collar and fairing installed.

FIGS. 25 and 27 show a fairing 35 having a locking mechanism 33.

DETAILED DESCRIPTION OF THE INVENTION

Figure 1:
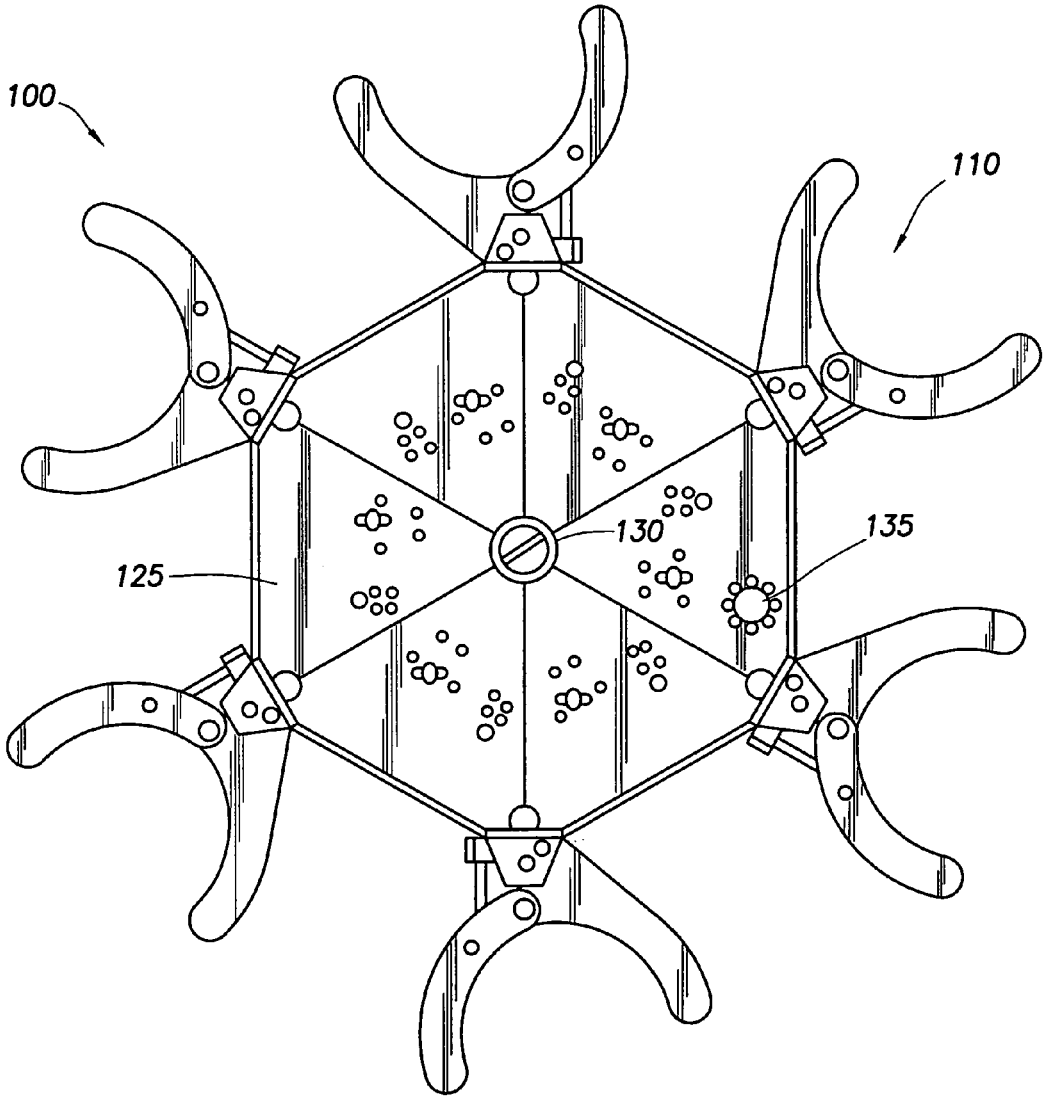
FIG. 1 is a top view of Diverless Suppression Deployment Tool (DSDT) 100, showing carousel clamps 110.

Referring first to FIG. 1, there is illustrated a top view of Diverless Suppression Deployment Tool (DSDT) 100, which is designed to be remotely operated without the use of human divers in the installation of clamshell-shaped strakes, shrouds, fairings, regular and ultra-smooth sleeves and other VIV and drag reduction equipment underwater to such structures, including but not limited to, oil and gas drilling or production risers, steel catenary risers, and anchor tendons. Slight modifications in DSDT 100 might be required for each particular type of VIV and drag reduction equipment to be installed. These modifications generally will involve modification to clamps 110 so that they can physically accommodate the various types of VIV and drag reduction equipment to be installed.

Figure 2:
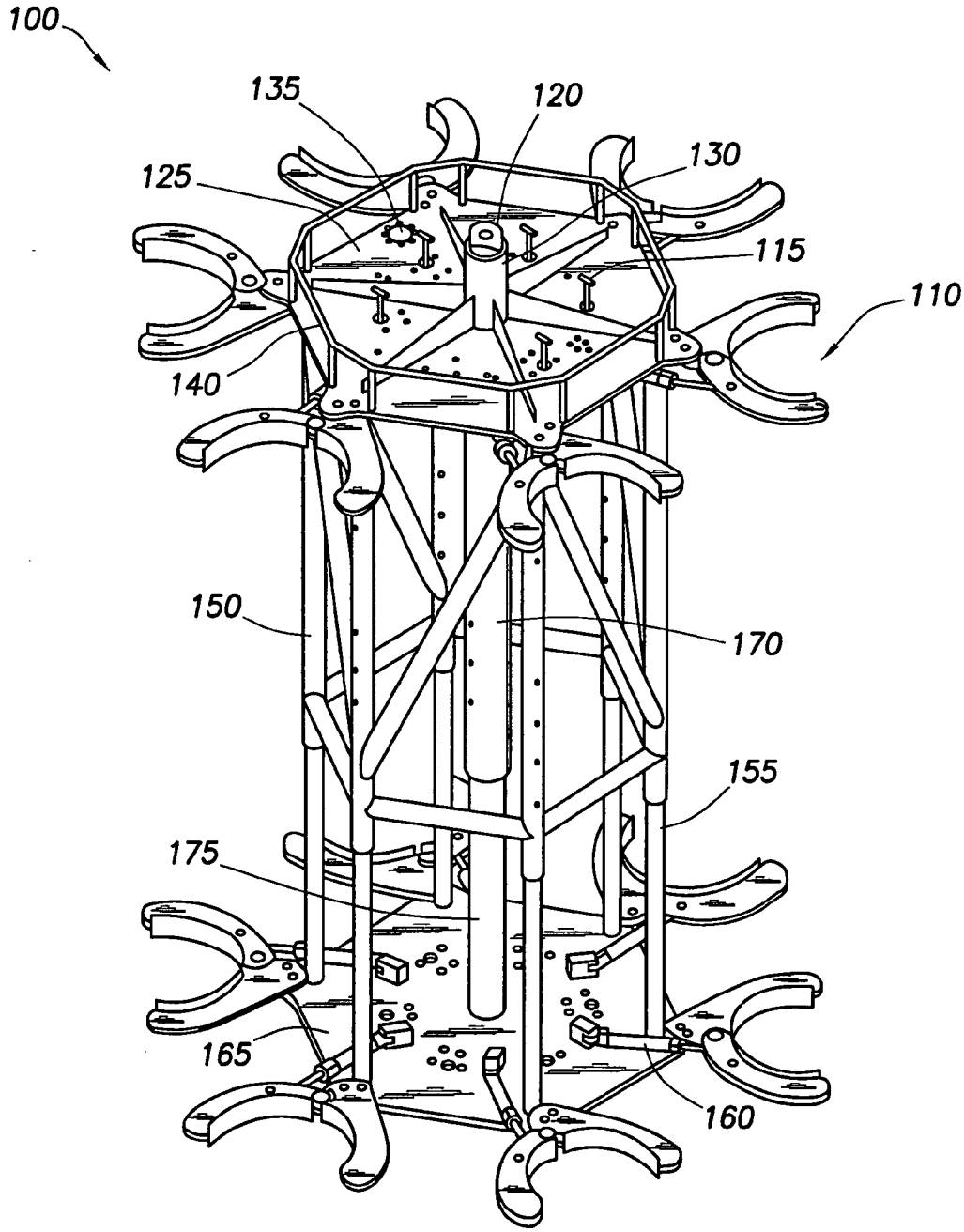
FIG. 2 is a side elevational view of DSDT 100 showing tubular framework supports 150 and 155.

For example, the embodiment as shown in FIGS. 1 and 2 is more conducive for the installation of helical strakes.

Ultra-smooth sleeves are described in U.S. patent application Ser. No. 09/625,893 filed Jul. 26, 2000 by Allen et al., which is incorporated herein by reference.

Shown in this embodiment of FIG. 1 are six carousel clamps 110 connected to top plate 125 of DSDT 100. Clamps 110 are designed to hold such VIV and drag reduction structures such as a strake, sleeve or other substantially cylindrical device. Also shown is top plate 125 attached to brace 130, which in this embodiment comprises six lateral braces, but may comprise an unlimited number of lateral braces. Top plate 125 defines hydraulics port opening 135, which provides access for a valve and hydraulic control system lines through DSDT 100 from water surface 910, illustrated in FIG. 9.

Referring now to FIG. 2, there is illustrated a lateral view of DSDT 100 of FIG. 1, showing six carousel clamps 110 connected to top plate 125. Carousel clamps 110 are designed to hold structures similar to a strake, sleeve or other substantially cylindrical device. It should be noted that an unlimited number of clamps may be connected to the top plate 125 of DSDT 100, so long as that number is suitable for completing a task in a flowing fluid environment. The number of clamps may be about two, preferably about four, more preferably about six, even more preferably about eight, still more preferably about ten, yet more preferably about twelve. A similar range of numbers of clamps may also be connected to bottom plate 165 of DSDT 100.

FIG. 2 also illustrates brace 130 with connector 120 designed to attach to a line for lowering and raising DSDT 100. Also shown are six ball valves 115 each used for hydraulically controlling one pair of clamps 110 oriented in a vertical line, between one clamp 110 connected to top plate 125 and another clamp 110 connected to bottom plate 165. Shown also is rod assembly 140 connected to top plate 125, wherein assembly 140 serves as a handle for manipulation of DSDT 100 by a remotely operated vehicle.

Also shown in FIG. 2 is first tubular brace 150, comprised of vertical and cross pieces which are interconnected with second tubular brace 155, which is in turn connected to bottom plate 165. In addition, first central tube 170 is connected to top plate 125 and to second central tube 175, which in turn is connected to bottom plate 165. Braces 150 and 155, central tubes 170 and 175, and plates 125 and comprise a framework.

Shown in FIG. 2 also are hydraulic cylinders 160, each of which connects one clamp 110 with either top plate 125 or bottom plate 165. A tubular hydraulic system (not shown), containing a hydraulic fluid, extends from hydraulics port 135 at least partially through tubular braces 150 and 155 and central tubes 170 and 175 to hydraulic cylinders 160. Hydraulic cylinders 160 are supplied with hydraulic fluid and hydraulic fluid pressure modulations to open and close clamps 110 which can hold clamshell devices such as strakes, shrouds, fairings or sleeves and close them around a structure.

Figure 3:
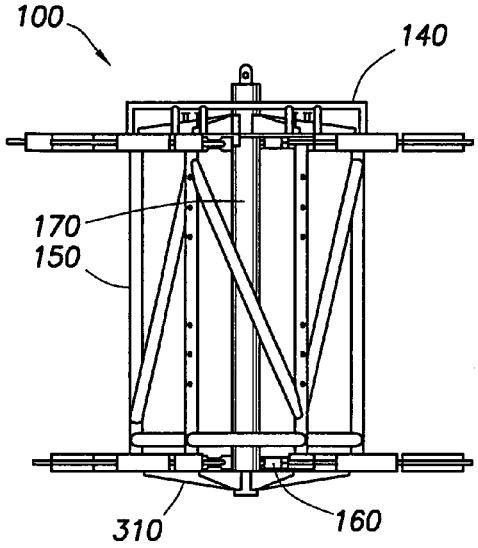
FIG. 3 is a side elevational view of DSDT 100 in a shortened or retracted position.

Referring now to FIG. 3, there is illustrated a side view of DSDT 100 in a retracted position that minimizes the size of DSDT 100 for storage and handling. Shown are first tubular brace 150, first central tube 170, rod assembly 140, hydraulic cylinder 160, and bottom brace 310.

Figure 4:
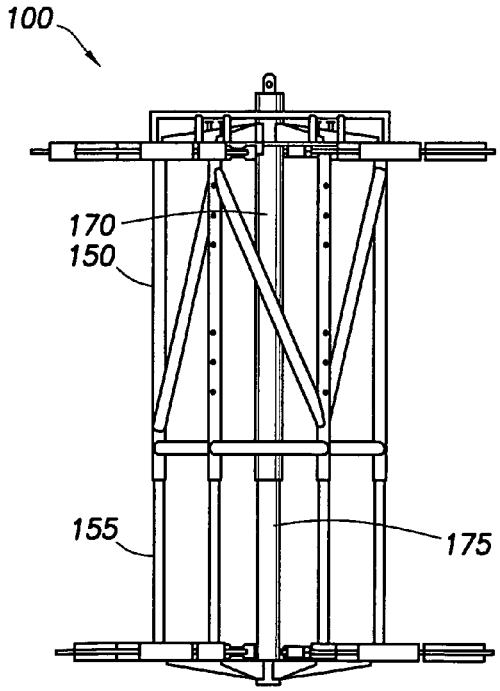
FIG. 4 is a side elevational view of DSDT 100 in an extended position.

Referring next to FIG. 4, there is illustrated an extended position for DSDT 100, showing first brace 150, first central tube 170, second brace 155, and second central tube 175. Second brace 155 and second central tube 175 are capable of moving into and partially out of first brace 150 and first cental tube 175, respectively. An extended position for DSDT 100 allows it to carry and install longer strakes, shrouds, fairings or other sleeve-like structures than would be possible with the retracted position of DSDT 100, shown in FIG. 3.

Figure 5:
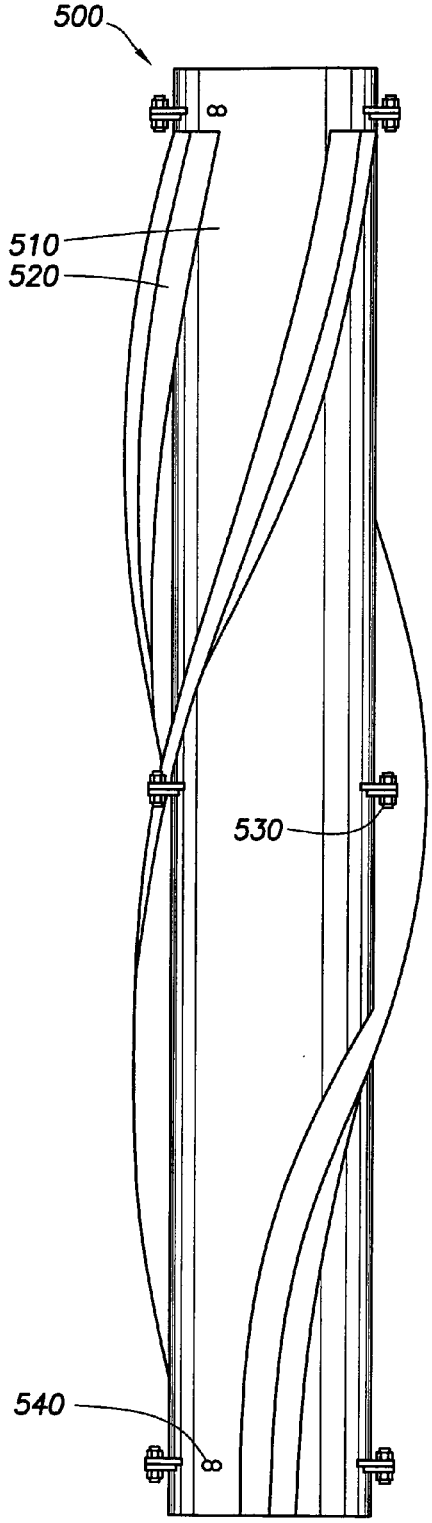
FIG. 5 is an illustration of a helical strake with nipples.

Referring next to FIG. 5, there is illustrated a side view of clamshell helical strake 500, with tubular body 510 and fins 520 projecting from tubular body 510. Any number of apparatus and methods could be utilized to anchor strake 500 to carousel clamp 110 while strake 500 is being carried and installed by DSDT 100. As a non-limiting example, nipples 540 are shown projecting out of each end of the exterior of strake 500 and will mate with a matching recess in clamp 110, while Hinge/clamps 530 are shown in their closed position on both sides of strake 500. Hinge/clamps 530 are normally closed on both sides of strake 500 only during shipping or after strake 500 has been fastened around a structure such as a riser, or horizontal or catenary pipe. At other times, hinge/clamps 530 are closed on one side of strake 500 and open on the other side. With closed hinge/clamps 530 on just one side of strake 500, hinge/clamps 530 serve as hinges allowing clamshell strake 500 to open like a clamshell on the side of strake 500 opposite the closed hinge/clamps 530.

Of course, the nipples and recesses could be reversed, that is, the nipples could be on clamp 110, and the mating recesses on strake 500 as is shown in an alternative embodiment in FIG. 7, and as shown connected in FIG. 12 (with FIGS. 7 and 12 discussed in more detail below).

Figure 6:
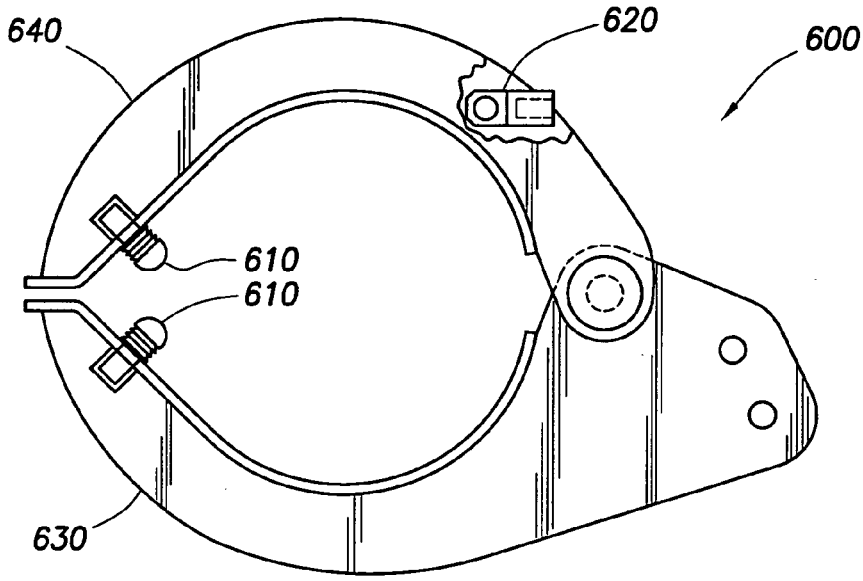
FIG. 6 is an illustration of carousel clamp 600 in its closed position and designed for holding a fairing.

Referring now to FIG. 6, there is illustrated one embodiment of a clamp designed to hold a tear-drop shaped fairing both in an open and a closed position (another embodiment is discussed below).

Carousel clamp 600, shown in its closed position, is comprised primarily of two arms, first arm 630 and second arm 640. Shown are nipples 610 in arms 630 and 640. These nipples 610 are designed to pass through an opening on a fairing and temporarily anchor a fairing to an interior face of the clamp 600. Attachment 620 is designed to attach to hydraulic cylinder 160, which cylinder 160, when activated, can open and close clamp 600.

In some instances, depending upon the circumference of the fairing, and flexibility of the materials, the essentially circular shape of the back of closed clamp 600 as shown in FIG. 6 is likely to cause problems handling a fairing, as the fairing will bow back and strike clamp 600, and will either be unstable or prone to coming loose.

Figure 14:
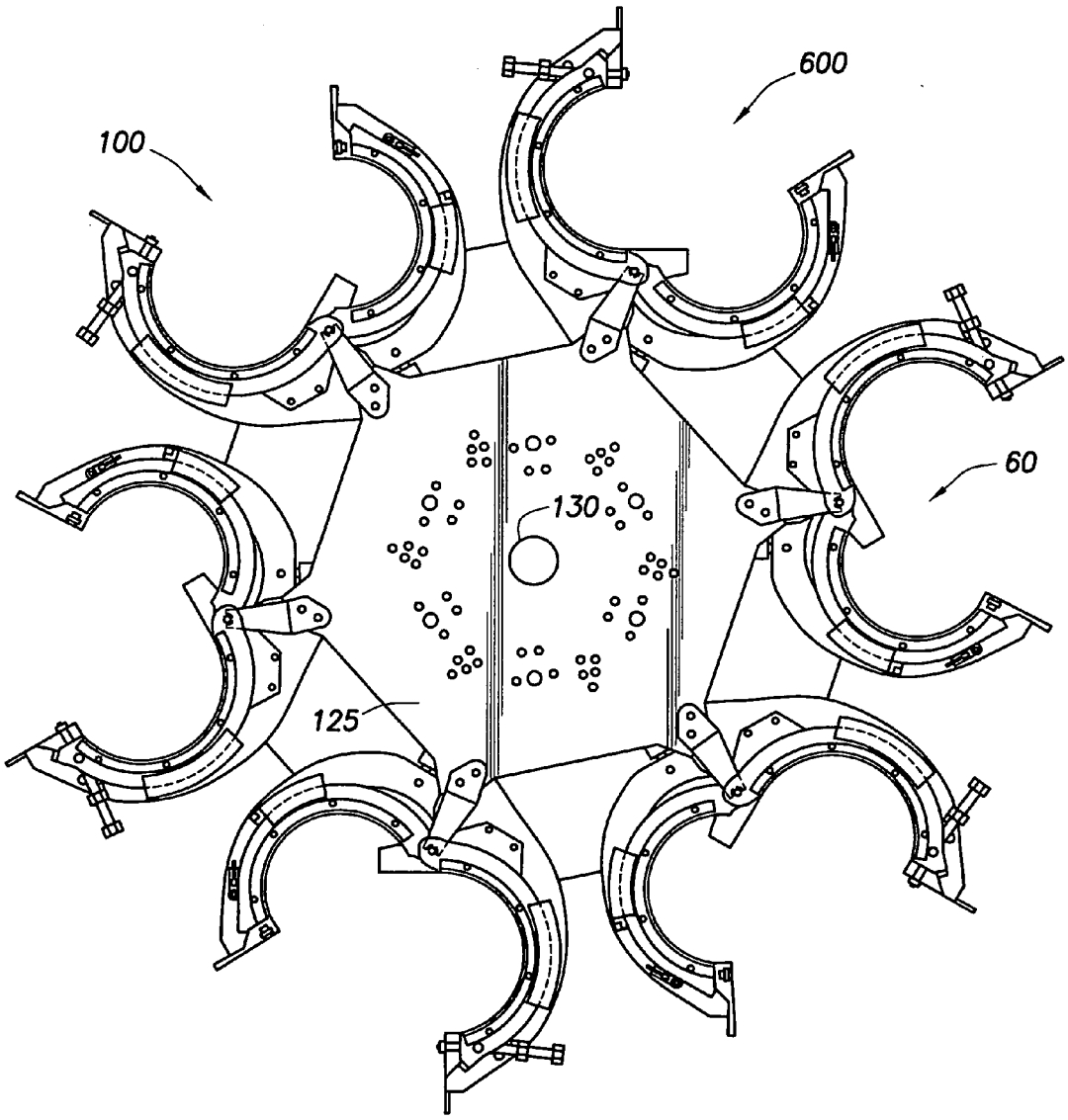
FIG. 14 shows an equivalent view to FIG. 1 showing a DSDT 100, except that alternative clamp 600 of FIG. 13 has replaced collar 110.

A preferred alternative embodiment of clamp 600 is shown in FIG. 13, showing a top view of alternative clamp 600 with a fairing installed. For alternative clamp 600, its arms 630 and 640 are provided different rotation axis, which operate to provide space for a closed fairing to bow backward. In more detail, alternative clamp 600 further includes fairing retainer mechanism 631 and 641 on their respective arms 630 and 640. Also shown are fixed collar grip 632, collar index 633, closer cylinder 644, stiffener 643, and collar closer grip 642. Referring additionally to FIG. 14, there is shown an equivalent view to FIG. 1 showing a DSDT 100, except that alternative clamp 600 of FIG. 13 has replaced collar 110.

Figure 7:
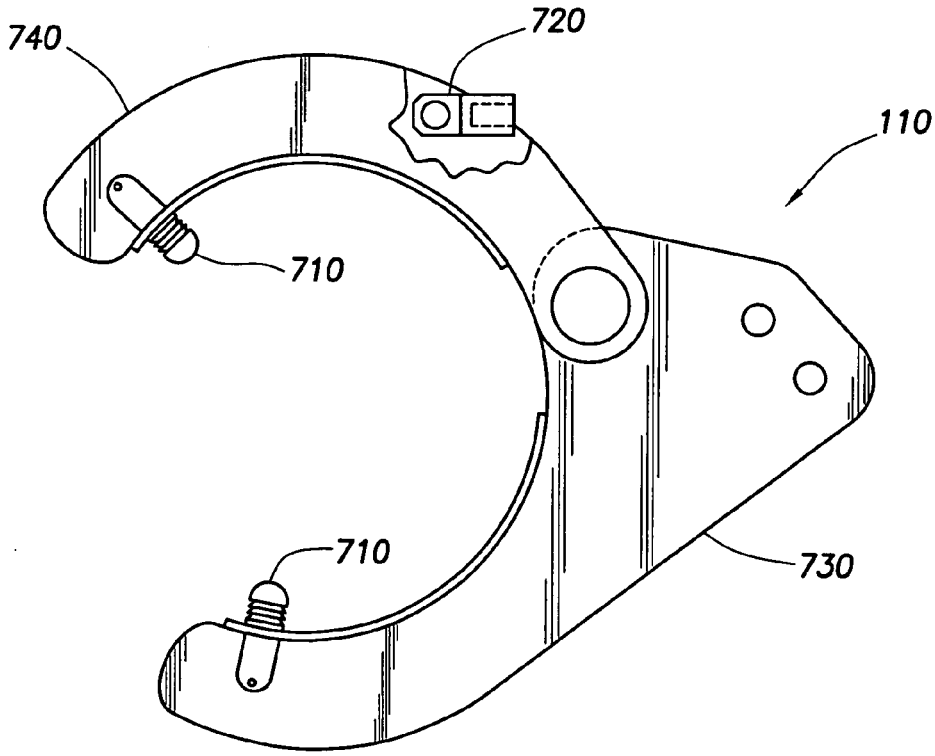
FIG. 7 is an illustration of carousel clamp 110 in its open position and designed to hold such devices as a helical strake.

Referring next to FIG. 7, there is illustrated carousel clamp 110 with first arm 730 and second arm 740. Clamp 110 is designed to hold strake 500. Shown inserted into arms 730 and 740 are nipples 710 which are designed to penetrate an opening on strake 500 and temporarily anchor strake 500 to clamp 110. Attachment 720 in arm 740 is designed to attach to hydraulic cylinder 160. Hydraulic cylinder 160, when activated, can open and close clamp 110.

Figure 8A:
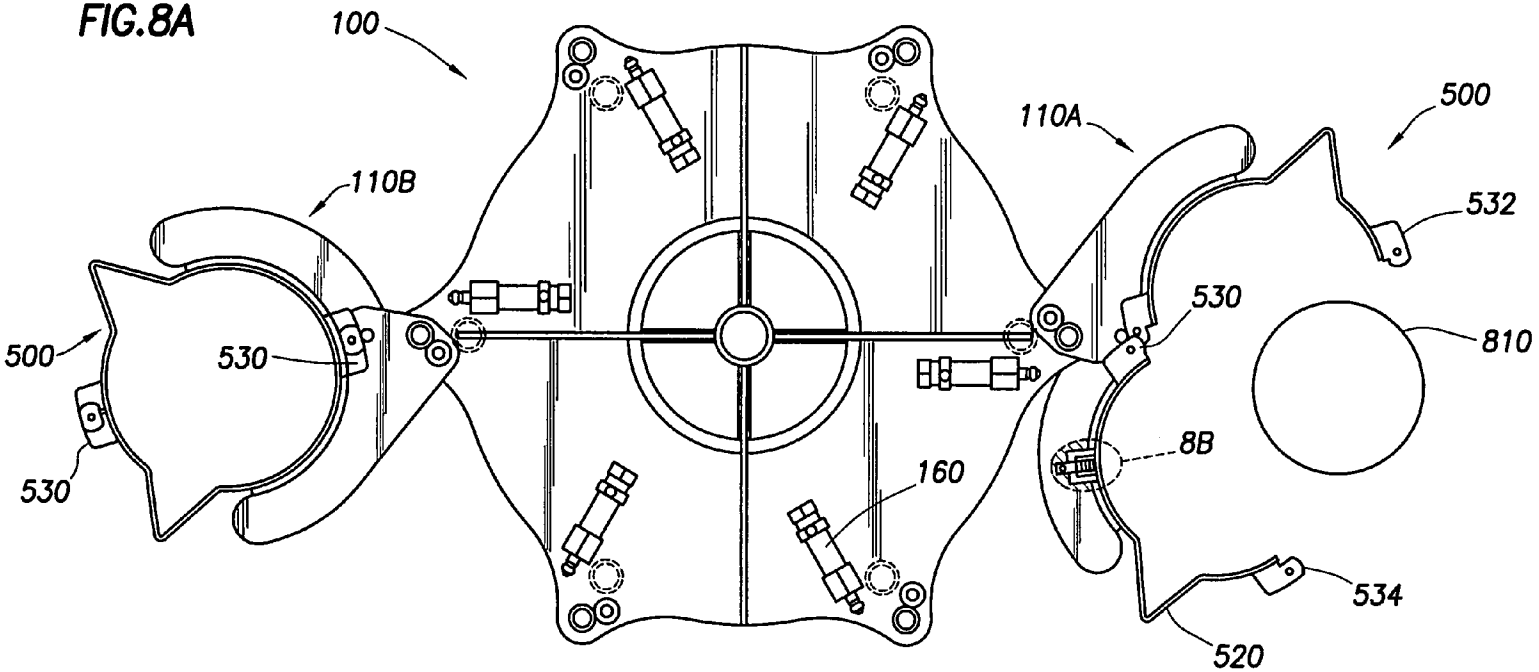
FIG. 8A is a top view of DSDT 100 with clamp 110A open and 110B closed.

Referring now to FIG. 8A, there is illustrated a top view of DSDT 100 with carousel clamps 110A and 110B at two of six possible positions. Clamp 110A is open and has attached to it strake 500 in an open position. Fin 520 of strake 500 is shown in cross-section. Also shown is a top or cross-sectional view of riser 810. Manipulation of DSDT 100 positions strake 500 around an underwater structure such as riser 810. After strake 500 is positioned around a structure such as riser 810, clamp 110 is closed, thereby closing strake 500 closely around riser 810. With strake 500 closed, hinge/clamp halves 532 and 534 are positioned adjacent to and overlapping each other. Closed strake 500 is shown attached to clamp 110B. Closed hinge/clamps 530, comprised of hinge/clamp halves 532 and 534 are positioned on two sides of strake 500. One hinge/clamp 530 acted as a hinge until strake 500 was closed. The remaining hinge/clamp 530 can be locked closed by inserting a captive pin into it after it is closed.

Figure 8B:
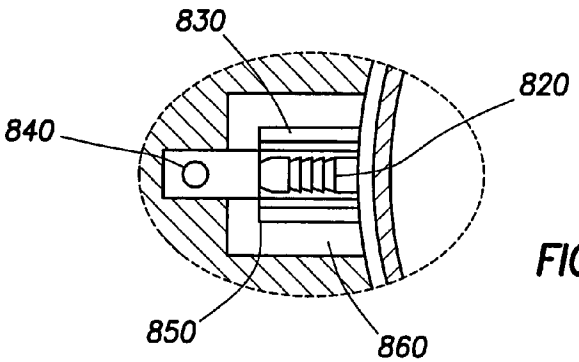
FIG. 8B is a detailed illustration of nipple 820 attached to strake 500.

Referring next to FIG. 8B, which is a detail of clamp 110A in FIG. 8A, there is illustrated nipple 820 attached to strake 500 inserted inside of rubber padding 830 held by coupling 850 (again, any suitable type of connection can be used in place of the nipple/recess, and the nipple/recess can be reversed). Coupling 850 is encircled by space 860, which allows limited movement of coupling 850 inside of clamp 110A. Coupling can rotate to a limited extent about pivot point 840.

Figure 9:
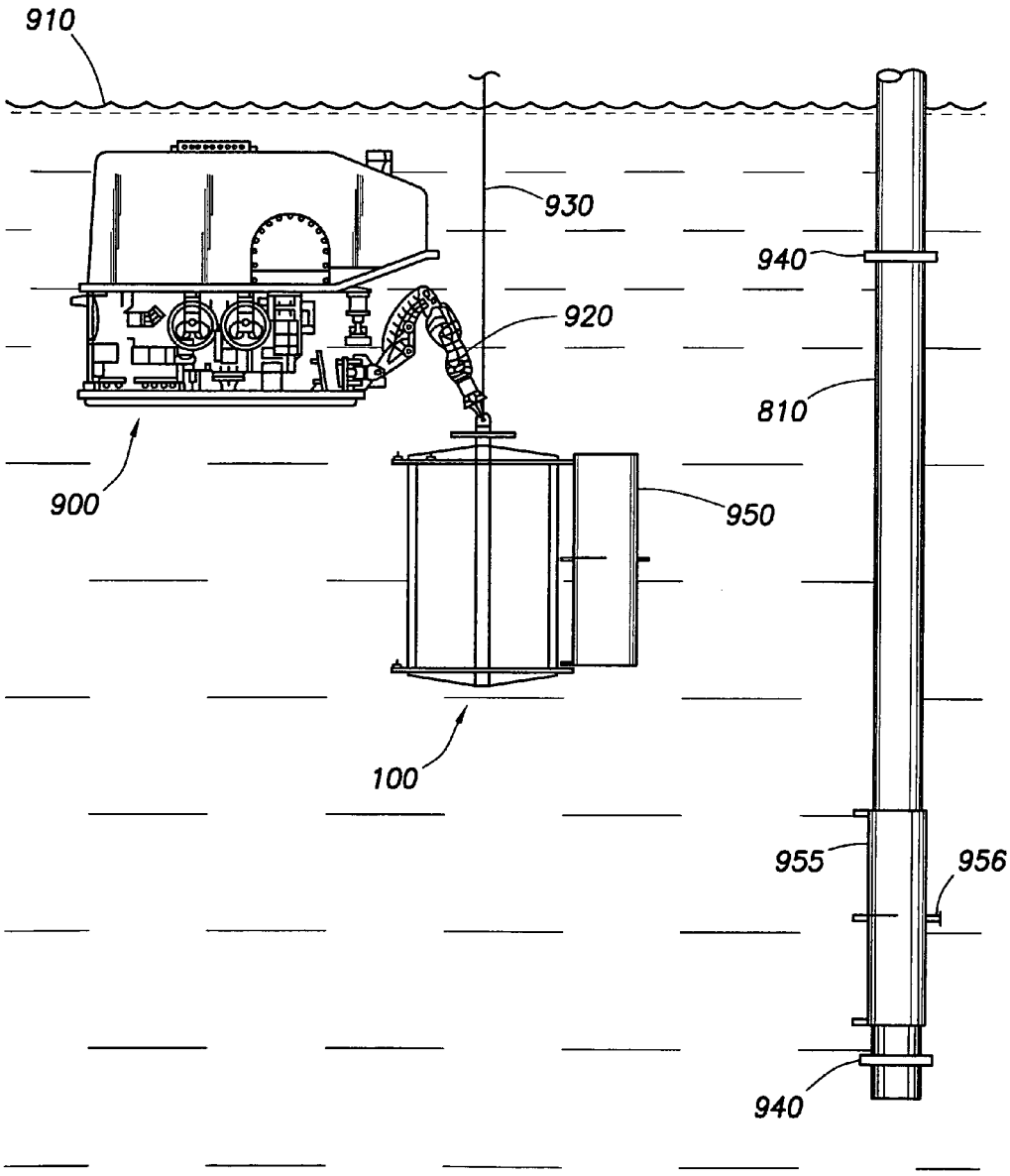
FIG. 9 is an illustration of remotely operated vehicle (ROV) 900 manipulating Diverless Suppression Deployment Tool (DSDT) 100.

Referring now to FIG. 9, there is illustrated remotely operated vehicle (ROV) 900 manipulating, via arm 920, DSDT 100. DSDT 100 is suspended by line 930 from the vicinity of water's surface 910. Line 930 carries hydraulic lines 935 (not shown) that extend from a vessel or production platform (not shown) into DSDT 100 for the purpose of operating hydraulic cylinders 160 to open and close clamps such as clamps 110, which can carry sleeve-like devices. DSDT 100 is shown carrying fairing 950 to be placed around riser 810. Fairing 950 is to be placed above previously positioned fairing 955.

FIG. 9 can further be used to illustrate an overview of DSDT 100 deployment where the steps involve DSDT 100 being positioned adjacent to the riser on which the strakes, shrouds, fairings or other sleeve-like devices, including flotation modules, will be installed. The most effective way to control the uppermost position of sleeves around riser 810 is to attach one collar 940 above the area where the DSDT 100 is to be lowered.

Strakes, shrouds, fairings, or other sleeve-like devices, will stack up on each other if they have low buoyancy and sink to another collar 940 placed around riser 810 at a desired lower stop point. DSDT 100 can be lowered to the bottom position and work can commence from the bottom-most position upward. When the DSDT 100 is at the proper position, the first strake or fairing section can be opened by retracting hydraulic cylinder 160. ROV 900 can then assist by gently tugging the DSDT 100 over to engage the strake or fairing around the riser. DSDT 100 should be about a foot above the lower collar 940. Once the clamshell device, such as strake, shroud, fairing, or sleeve has engaged the riser, the hydraulic cylinder is extended. This closes the clamshell around the riser. At this time ROV 900 can visually check to see if the alignment looks good. If so, ROV 900 strokes a captive pin 956 downward, locking the strake, fairing or clamshell sleeve around the riser. Carousel arms, such as 630 and 640 are then disengaged by retracting the hydraulic cylinders. DSDT 100 will then move away from the riser, and the first strake, fairing or clamshell sleeve section will drop down, coming to rest on the lower collar 940. DSDT 100 is then moved up until it is about a foot above the first of the sleeve-like devices.

The installation continues until all six sleeve-like devices are installed. DSDT 100 is then retrieved and six more sections are installed. The installation is not extremely fast. It should keep in mind, however, that only platform resources are being used, so the job can be done in times of inactivity and calm sea states.

Figure 10:
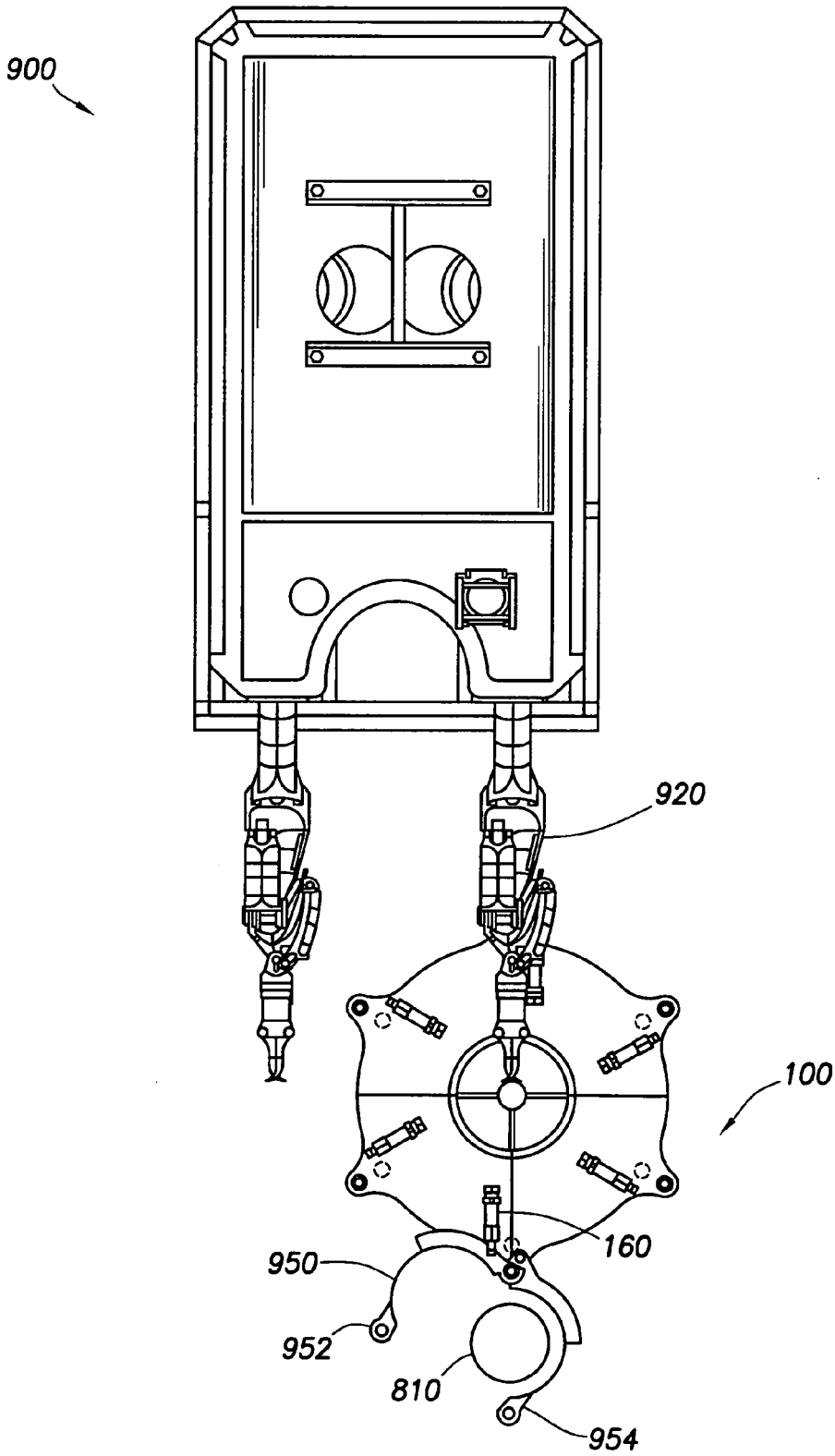
FIG. 10 is an illustration of a top view of ROV 900 manipulating DSDT 100 to encircle fairing 950.

Referring now to FIG. 10, there is illustrated a top view of ROV 900 manipulating with arm 920 DSDT 100 to encircle riser 810 with fairing 950. Only one of 6 positions around DSDT 100 is shown as occupied with a carousel clamp, such as here clamp 640 for installation of fairings. However, all six position may be occupied by carousel clamps. Note that hydraulic cylinder 160 is in a retracted position. Shown are connecting ends 952 and 954 of fairing 950.

Figure 11:
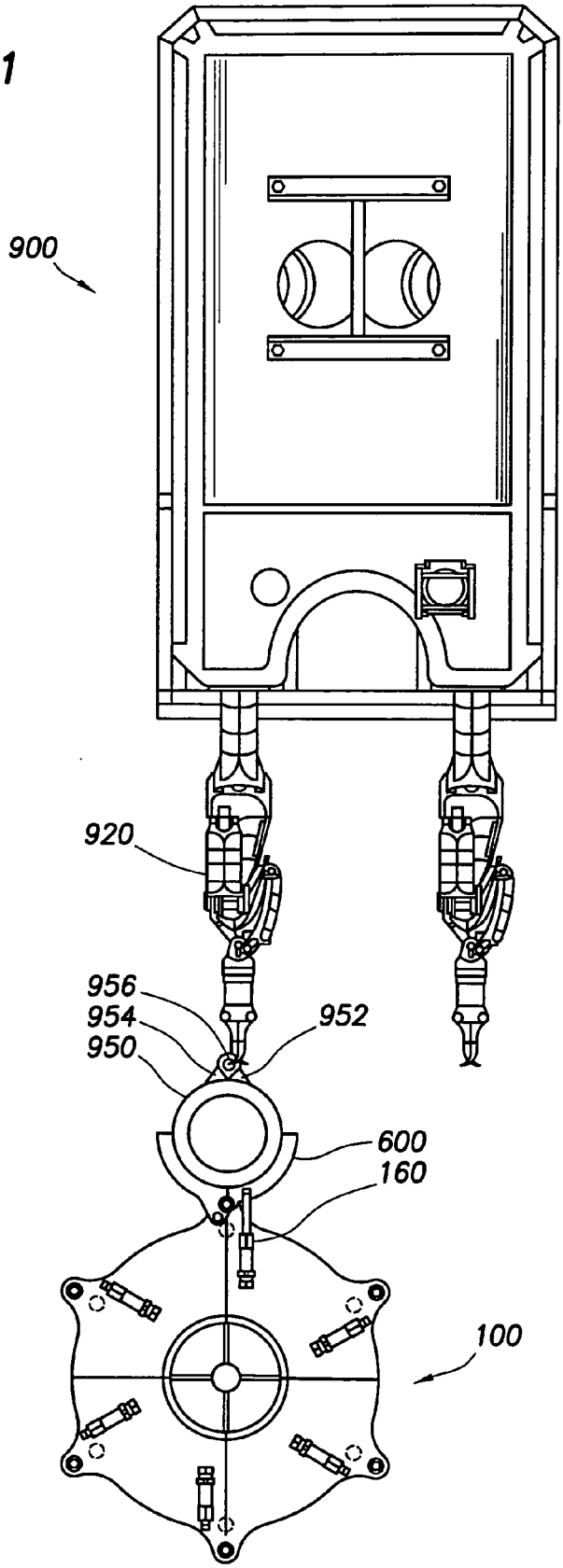
FIG. 11 is an illustration of a top view of ROV 900 manipulating fairing 950 to close around riser 810.

Referring to FIG. 11, there is illustrated a fastening step occurring after the encircling step shown in FIG. 10. FIG. 11 illustrates a top view of ROV 900 closing together ends 952 and 954 with arm 920 so that the ends can be connected to each other. Note that hydraulic cylinder 160 is extended forcing clamp 600 to close, thereby closing fairing 950. Captive pin 956 can be stroked down by ROV 900 to lock the fairing in place.

Figure 15:
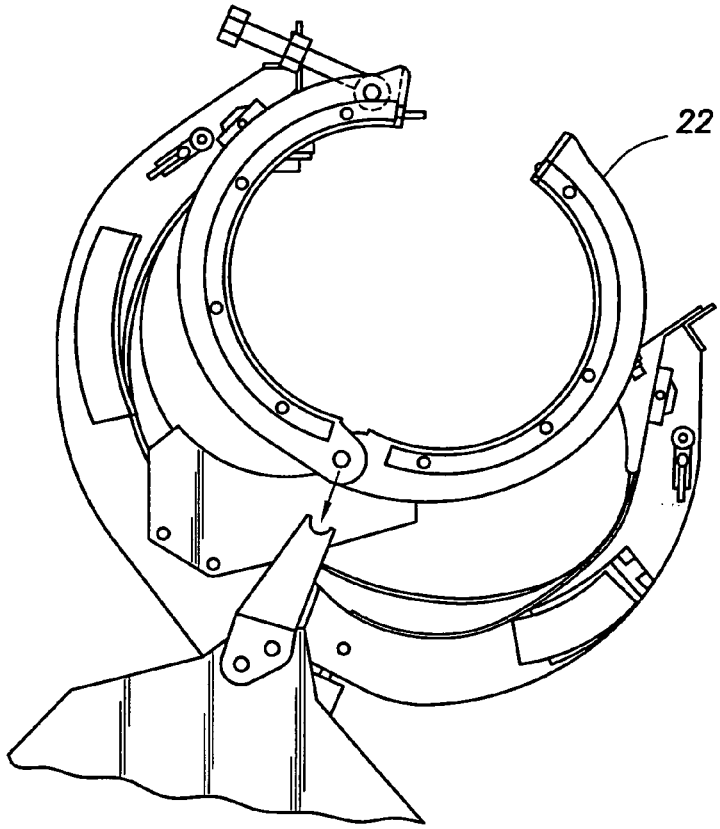
FIGS. 15-24 shown a sequence of installing a collar onto a riser, focusing on a top view of one alternative clamp 600 (as shown in FIG. 13) of a DSDT 100, specifically.
Figure 16:
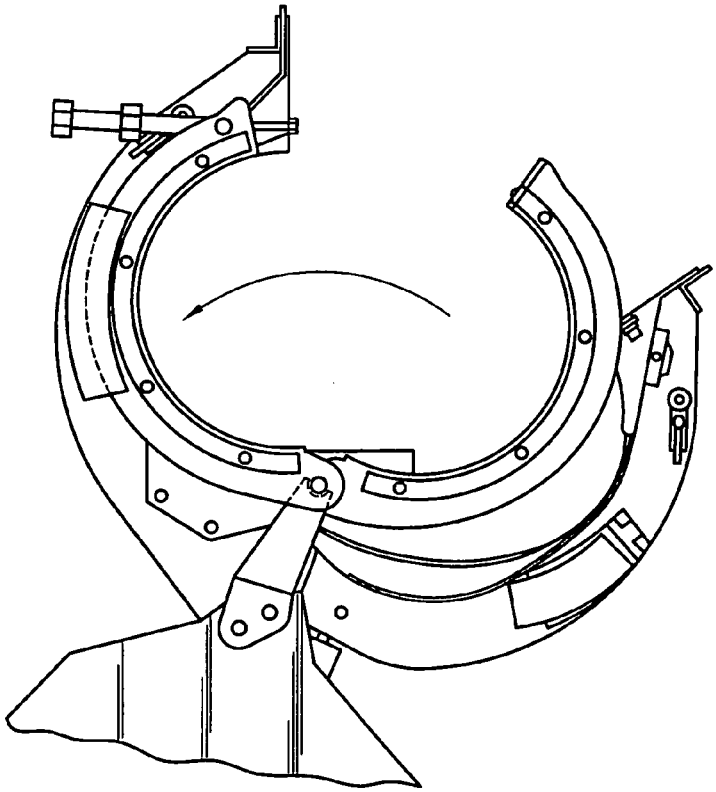
Figure 17:
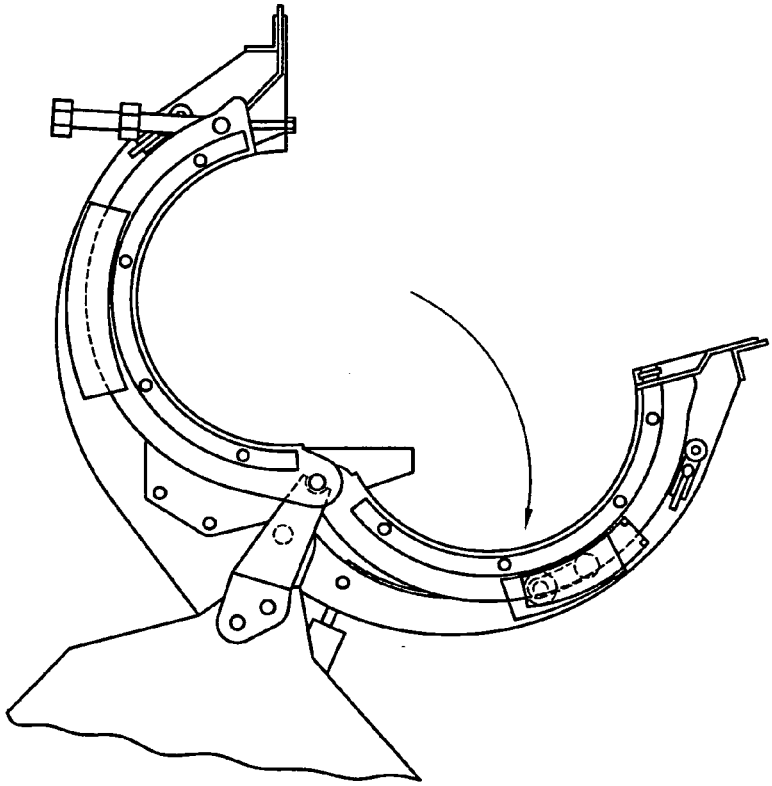
Figure 18:
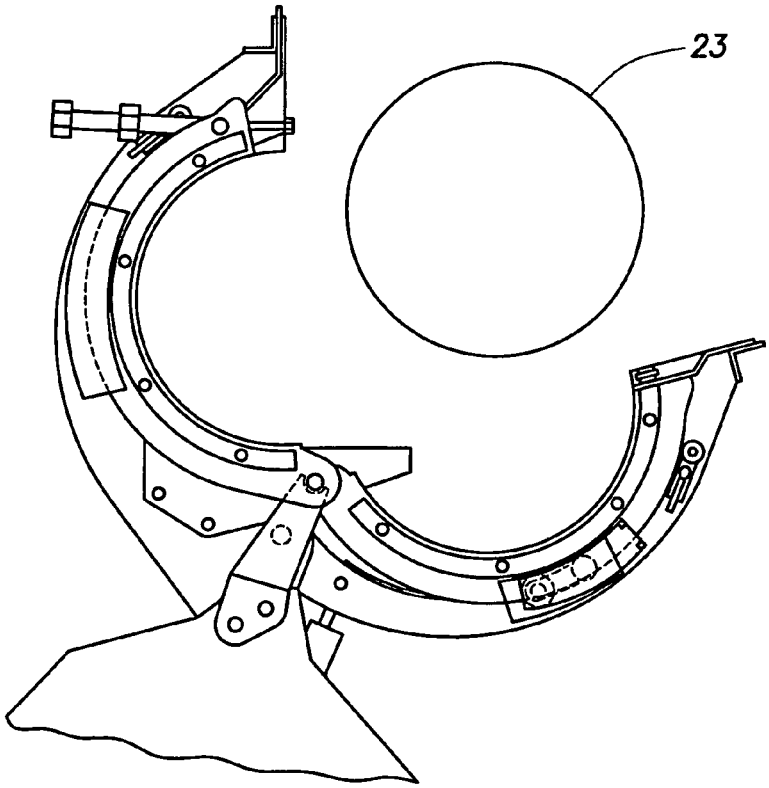
Figure 19:
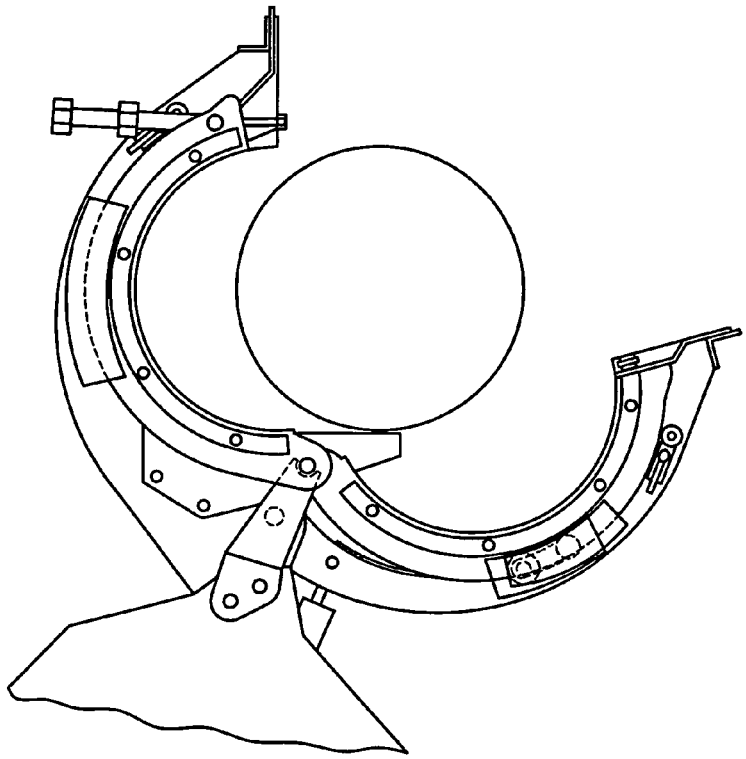
Figure 20:
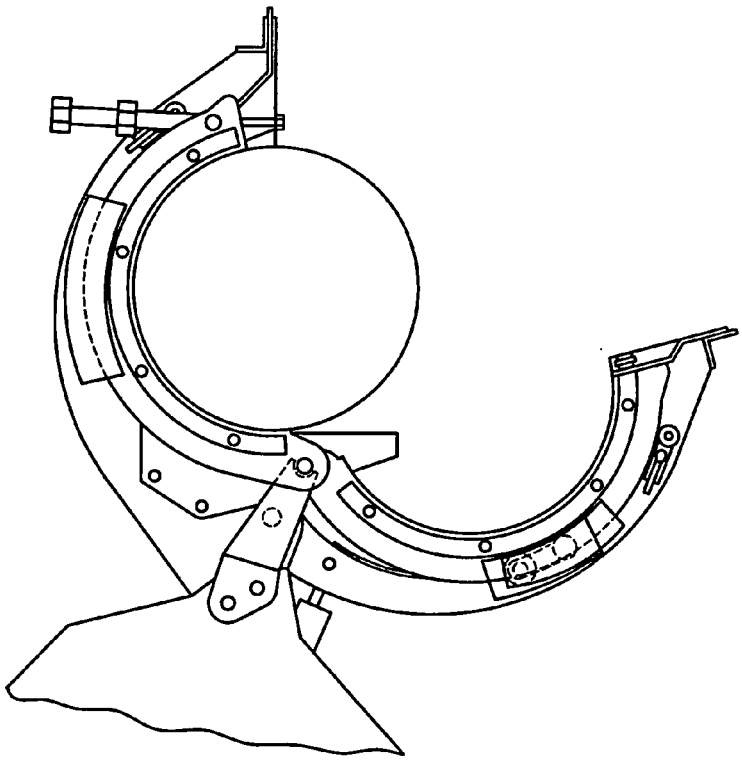
Figure 21:
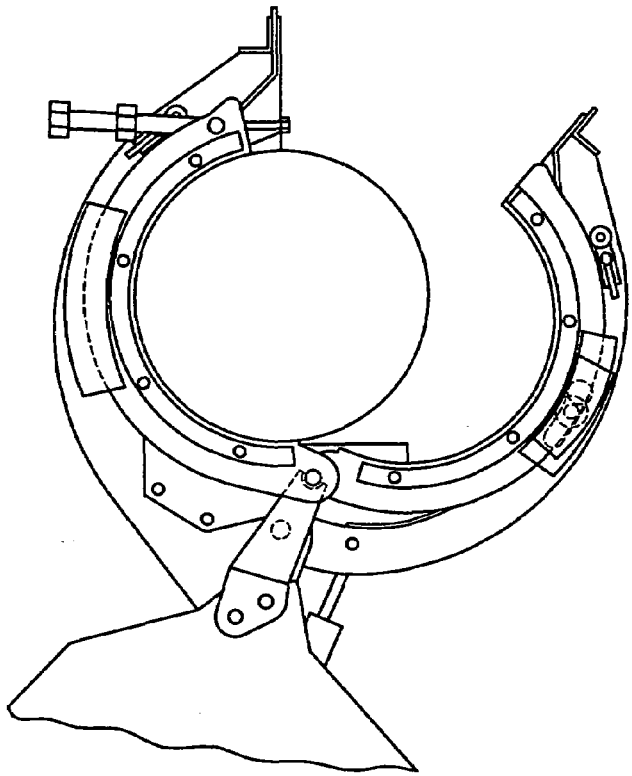
Figure 22:
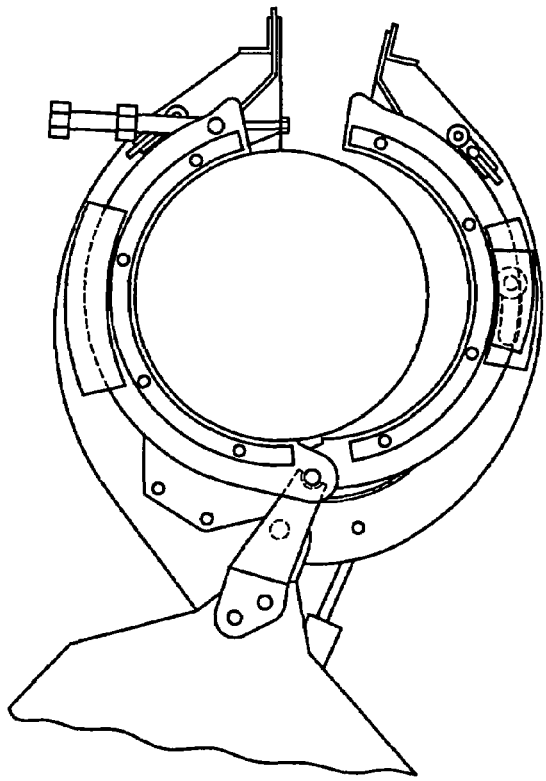
Figure 23:
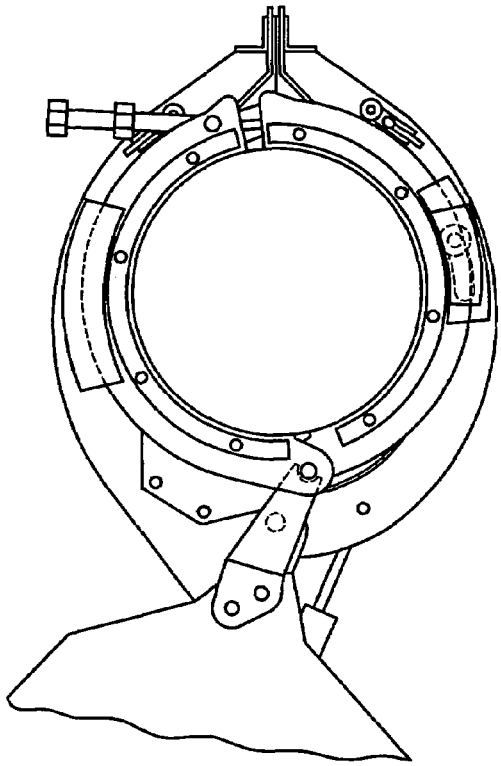
Figure 24:
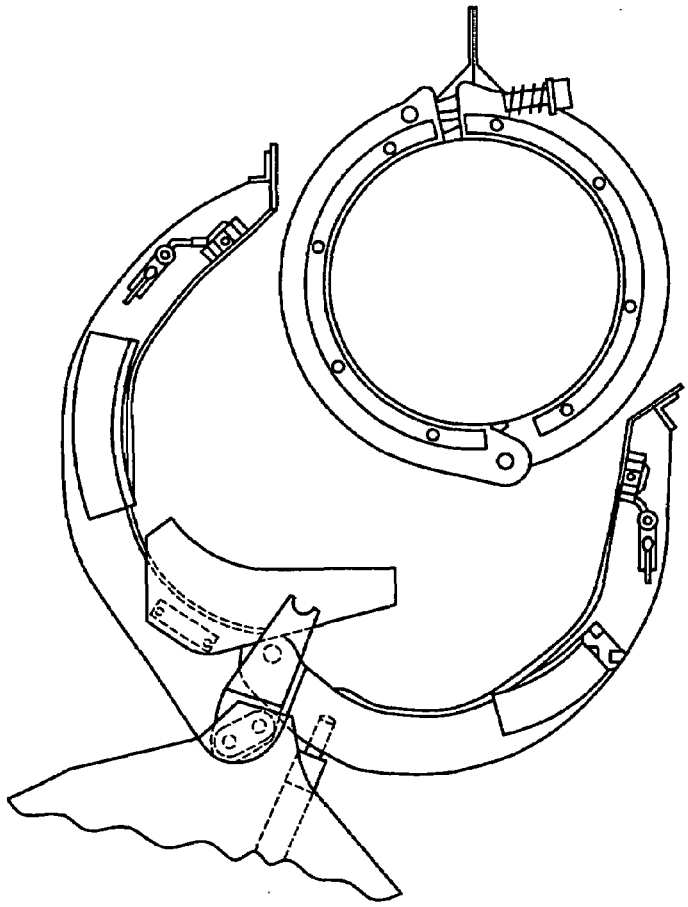

Referring now to FIGS. 15-24, there is shown a sequence of installing a collar onto a riser. This sequence focuses on a top view of one alternative clamp 600 (as shown in FIG. 13, with the reference numbers of FIG. 13 applying to these FIGS. 15-24) of a DSDT. Specifically, FIG. 15 shows a collar 22 being inserted thereto; FIG. 16 shows a collar half rotated into fixed insert; FIG. 17 shows an opposite half of the collar rotated into moving insert; FIG. 18 shows the DSDT being moved onto the pipe 23; FIG. 19 shows a further advance of the DSDT being moved onto the pipe; FIG. 20 shows an even further advance of the DSDT being moved onto the pipe; FIG. 21 shows the cylinder closing the fairing clamp as the collar grip drives the collar closed; FIG. 22 shows a further advance of the cylinder closing the fairing clamp as the collar grip drives the collar closed; FIG. 23 shows an even further advance of the cylinder closing the fairing clamp as the collar grip drives the collar closed; FIG. 24 shows the DSDT moving away from the riser pipe with collar and fairing installed.

Figures 26A, 26B, 26C, 26D:
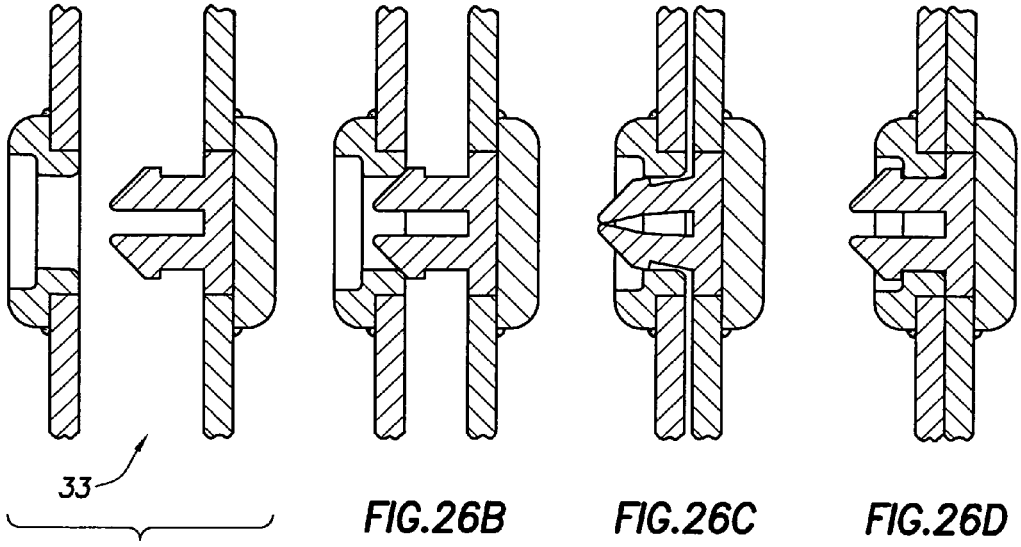
FIG. 26 is a sequence showing the locking of locking mechanism 33.
Figure 27A:
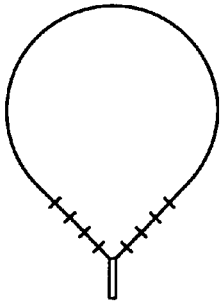
Figure 27B:
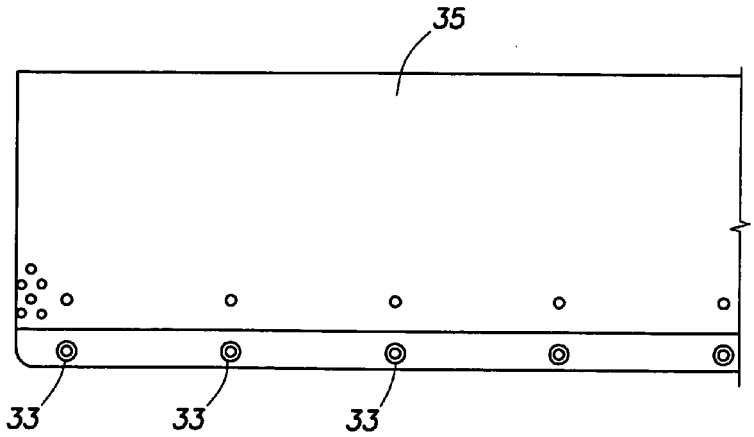

Although any fairing is believed to be suitable for use in the present invention, preferably a fairing utilized in the present invention will comprise a locking mechanism that will allow the DSDT to lock the fairing around a riser pipe upon installation. Generally, the ends of the fairing will be outfitted with a mating locking mechanism that locks upon contact. A non-limiting example of such a locking mechanism 33 is shown in FIGS. 25 and 27 as part of fairing 35. A sequence showing the locking of locking mechanism 33 is shown in FIG. 26.

While the Diverless Suppression Deployment Tool 100 has been described as being used in aquatic environments, that embodiment or another embodiment of the present invention may also be used for installing VIV and drag reduction devices on elongated structures in atmospheric environments with the use of an apparatus such as a crane.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. A method of remotely installing a clamshell device around an element having a diameter, the method comprising:

(a) positioning a clamshell tool adjacent to the element, wherein the clamshell tool carries the clamshell device selected from the group consisting of vortex-induced vibration reduction devices and drag reduction devices;

(b) moving the clamshell tool in an open configuration to position the clamshell device around the element;

(c) closing the clamshell tool from the open configuration to a closed configuration to close the clamshell device around the element, wherein the device covers from about 50% to about 100% of the diameter of the element;

(d) securing the device in position around the diameter of the element; and (e) removing the tool and leaving the device secured around the element.

2. The method of claim 1, wherein the tool of step (a) carries at least two clamshell devices, the method further comprising:

(e) repeating steps (a), (b), (c), and (d).

3. The method of claim 1, wherein the clamshell device installed is an ultra-smooth sleeve.

4. The method of claim 1, wherein the clamshell device installed is a flotation module.

5. The method of claim 1, wherein the clamshell device installed is a fairing.

6. The method of claim 1, wherein the clamshell device installed is a strake.

7. The method of claim 1, wherein the tool is operated underwater with a remotely operated vehicle.

* * * * *